US006286399B1

(12) United States Patent
Ferster

(10) Patent No.: US 6,286,399 B1
(45) Date of Patent: Sep. 11, 2001

(54) RADIATOR CAP EASY OPENER DEVICE

(76) Inventor: Isadore Ferster, P.O. Box 184, Wilmer, AL (US) 36587

( * ) Notice: Subject to any disclaimer, the term of this patent is extended or adjusted under 35 U.S.C. 154(b) by 0 days.

(21) Appl. No.: 09/689,334

(22) Filed: Oct. 12, 2000

(51) Int. Cl.[7] ..... B25B 13/06
(52) U.S. Cl. ..... 81/121.1; 81/3.4
(58) Field of Search ..... 81/121.1, 176.1, 81/176.2, 3.4

(56) References Cited

U.S. PATENT DOCUMENTS

| | | | | |
|---|---|---|---|---|
| 1,415,440 | * | 5/1922 | Grein | 81/176.2 |
| 2,599,668 | * | 6/1952 | Taylor | 81/176.2 |
| 2,895,363 | * | 7/1959 | Cox | 81/125 |
| 2,940,344 | * | 6/1960 | Taylor, Sr. | 81/176.2 |
| 3,007,357 | * | 11/1961 | Nalley | 81/176.1 |
| 3,014,389 | * | 12/1961 | O'Hara | 81/176.2 |
| 3,035,466 | * | 5/1962 | Baker, Jr. | 81/176.1 |
| 3,037,408 | * | 6/1962 | Rives et al. | 81/176.3 |
| 3,048,067 | * | 8/1962 | Miles et al. | 81/176.1 |
| 3,121,355 | * | 2/1964 | Morel et al. | 81/176.2 |
| 3,186,263 | * | 6/1965 | Grote | 81/176.1 |
| 3,253,485 | * | 5/1966 | Grote | 81/176.1 |
| 3,481,227 | * | 12/1969 | Shook | 81/176.1 |
| 4,512,215 | * | 4/1985 | Krauchick | 81/3.44 |
| 4,542,666 | * | 9/1985 | White | 81/176.1 |
| 4,643,053 | * | 2/1987 | Rhodes | 81/90.3 |
| 4,836,065 | * | 6/1989 | Setliff | 81/124.2 |
| 4,846,025 | * | 7/1989 | Keller et al. | 81/3.09 |
| 4,914,985 | * | 4/1990 | Proctor | 81/3.44 |
| 5,896,785 | * | 4/1999 | Shaw et al. | 81/3.4 |

FOREIGN PATENT DOCUMENTS

| | | | | |
|---|---|---|---|---|
| 0272000 | * | 5/1934 | (IT) | 81/176.1 |
| 0051549 | * | 12/1941 | (NL) | 81/176.1 |

* cited by examiner

*Primary Examiner*—Joseph J. Hail, III
*Assistant Examiner*—David B. Thomas

(57) ABSTRACT

A device for removing radiator caps from automotice radiators for persons having less physical strengths. My invention is primarily for (disabled persons, housewives, weak and frail persons that operate a motor vehicle. Many persons of this group cannot remove and replace a radiator cap. My first embodiment is a six sided device FIG. 1A and FIG. 1B. This device is used on radiator caps FIG. 5 Simply place the device on top of the radiator cap. Grip firmly and turn about ⅛ turn counter-clockwise, the radiator cap is now loose and ready to be removed. My second embodiment with 3 thumbscrews 28 enable round flat caps FIG. 4 and more various sizes and shapes to be removed and replaced. The third embodiment FIG. 3A and FIG. 3B will remove and replace radiator caps equipped with pressure release levers. The pivotal strip 35 illustrates the raised lever position in FIG. 7 FIG. 6 shows the closed position. This embodiment will duplicate all the functions as the first and second embodiments. All of the above, illustrated and shown in my descriptions and operations. All three embodiments comprise one invention. The main function and purpose is to enable a person with less physical strengths to be able to remove and replace a radiator cap in order to check cooling fluids and be able to apply preventive maintenance. This will eliminate some costly repairs.

2 Claims, 4 Drawing Sheets

RADIATOR CAP EASY OPENER DEVICE

CROSS-REFERENCE RELATED TO APPLICATIONS

Not applicable

BACKGROUND

1. Field of Invention

This invention relates to automotive radiator, reservoir, fluid cooling system radiator caps.

2. Description of Prior Art

I have no knowledge of, nor have ever seen anything resembling my invention. 1 know of nothing in existence of any device that functions as my embodiments relating to automotive cooling system radiators or reservoirs. I have never seen any device in any store selling anything that resembles my invention.

OBJECTS AND ADVANTAGES

Summary, Ramifications, and Scope

Accordingly, some of the objects and advantages of my invention are;

(a) To provide easy loosening and removal of a radiator cap.

(b) To provide easy replacement and tightening of said cap.

(c) To enable persons with less physical attributes, to loosen, remove, replace and tighten said cap.

Note; if a radiator cap is not tightened to the maximum, a large amount of cooling fluid could be lost. This happens quite frequently, resulting in costly repairs.

(d) To provide an embodiment that can accomodate flat type radiator caps and radiator caps mounted with pressure release levers and other release types.

(e) to provide an embodiment that will function in severest of frigid weather conditions.

(f) to provide easy removal and replacement of various gripped shaped radiator caps such as square, circular, eliptical, hexagon, octagon, circular and square caps having protuding edges designed for easy gripping. This includes all other shapes not mentioned in the above.

(g) To provide an embodiment equipped with adjusters that will accomodate various sizes of radiator caps.

(h) To provide an embodiment that is light weight, approximately four ounces.

(i) To provide an embodiment that can be constructed of hardwoods, metals, molded plastics, laminates, combinations of metals and other rigid materials.

(j) To provide an embodiment that will function with radiator caps equipped with pressure release levers.

Although the description above contains many specificities, these should not be construed as limiting the scope of the invention but as merely providing illustrations of some of the presently preferred embodiments of this invention. For example the embodiments of my invention can have other shapes, such as circular, oval trapezoidal, triangular etc.

Thus the scope of the invention should be determined by the appended claims and their legal equivalents, rather than by the examples given.

DESCRIPTION

First Embodiment

FIG. 1A FIG. 1B

Has no moving parts, will fit a large group of radiator caps, easy to handle, easy to make.

A typical embodiment of the present invention is illustrated in FIG. 1A (top view) and FIG. 2A (bottom view). The base 10 is hexagon shaped metal 1.56 mm in thickness 18. The six vertical sides 14 and the metal base 10 are formed from a single piece of metal. The six vertical sides 14 vary in length. The sides measure between 30 mm and 37 mm. The height 18 is 12.5 mm. Open spaces 20 exist between sides. The spaces between the sides 20 also vary. The inside measurements between any two parallel sides 22 are approximately 6.35 mm. The base 10 is connected to a wooden handle 24 with 2 bolts and nuts 26. The handle 24 is approximately 14 cm long, slightly rounded. This embodiment has no moving parts.

Second Embodiment

FIG. 2A and FIG. 2B

This embodiment can be used with more different sizes and shapes than the first embodiment.

The second embodiment FIG. 2A and FIG. 2B structure is identical to the first embodiment FIG. 1A and FIG. 1B except for an added feature. This embodiment is fitted with 3 movable thumb screws 28 size 10/24 machine threads. These thumb screws 28 adjusts inwardly and outwardly thru 3 threaded sides, A 10/24 machine thread nut 30 is soldered to these sides adjusts inwardly and outwardly thru 3 threaded sides after the holes are drilled.

Third Embodiment

FIG. 3A and FIG. 3B

This embodiment can perform to almost any radiator cap made.

This embodiment will function with pressure release levers.

FIG. 3A and FIG. 3B illustrates the top view and bottom view.

A third embodiment of my invention has the same functional mechanical advantages of loosening, removing, replacing and tightening radiator caps as my first and second embodiments. This embodiment is formed from a single piece of metal. The base 32 is of square shaped metal 1.56 mm thick 16. There are 4 vertical sides. These sides vary in length. The shortest side 34*a* is 3 cm in length. The second shortest side 34*b* is 4 cm in length. The remaining two sides 34*e* are each 5 cm in length.

Sides 34*e* and 34*d* each have tapered corners at the top. The height of the sides 18 are 12.5 mm. the thickness 16 is 1.56 mm. The inside measurements between any two parallel sides 47 is 6.5 cm. A pivotal metal strip 35 is connected to the base 32 adjoining side 34*a*. This strip 35 measures 5 cm in length, 12.5 mm in width, and 1.56 mm in thickness. A nut and bolt 37 is used as a pivotal point connecting 32 and 35 as shown in FIG. 3A bottom view. A hole is drilled in 32 and 35 allowing the nut and bolt to connect to the pivot strip and base. The pivot strip 35 has a sweeping moving of approximately 60 degrees. A hole is drilled in sides 34*a* and 34*b*. A nut 30 is soldered to each of these sides. Two thumbscrews 28 are used as adjusters, as shown in FIG. 3A. A wooden handle 40 is attached to base 32 with 4 nuts and bolts 41. The wooden handle 40 has dimensions of 14 cm in length, 3.5 cm in width and 1.56 cm in thickness. The wooden handle 40 has a profile cutout 36 matching the base 32 as shown in FIG. 3B. This embodiment will accomodate radiator caps having pressure release levers for a mechanical advantage of loosening, removing, replacing, and tightening radiator caps. My invention will fit almost any size, shape, or form of radiator cap and do the job.

Operation FIG. 1A and FIG. 1B

The first embodiment is very easy to use. There are no moving parts. This embodiment is used with regular size flat caps. FIG. 5 shows a group of flat radiator caps that are equipped on many automobiles. Simply place this embodiment over the radiator cap. Make sure of a snug fit. Using both hands, grip the handle with one hand, hold the base 10 with the other hand. Turn the handle slowly about an eight of a turn in a counter clockwise direction, the radiator cap is now loose. To replace, use reverse procedures. Simply place the radiator cap back on the radiator, place the embodiment on the radiator cap making sure that it fits snugly. With a firm grip, slowly turn the handle clockwise til the radiator cap is tight.

Operation, Second Embodiment, FIG. 2A and FIG. 2B

The second embodiment will fit all the radiator caps as the first embodiment plus the added feature of adapting to even more flat type radiator caps. This embodiment can be used with circular radiator caps FIG. 4 It can be used with smaller sizes of various shapes, square, circular, hexagon, octagon, oval, eliptical etc. This embodiment has 3 adjusting thumbscrews 28 FIG. 2A and FIG. 2B, that are used to regulate and adjust to different sizes and shapes of flat type radiator caps. FIG. 9 illustrates a typical radiator and flat cap.

Operation, Third Embodiment FIG. 3A and FIG. 3B

This embodiment is equipped with a pivot strip 35 to accomodate radiator caps having pressure release levers as shown in FIG. 6 and FIG. 7.

This embodiment can be used with all the radiator cap sizes and shapes as the first and second embodiments. Place this embodiment on a radiator cap FIG, 8 equipped with a pressure release lever. Hold the embodiment tightly with two hands. With the forefinger of the left hand (still holding in place), lift the pressure lever FIG. 7 and slide the movable pivot strip 35 under the lever, in a counter-clock wise direction, move the pivot strip till it rests firmly on top base 32 shown in FIG. 3B and FIG. 7. The radiator cap is now ready to be loosened and removed. Simply turn the handle 40 about an eight of a turn in a counter-clockwise direction. The radiator cap with pressure release lever is now loosened ready to be removed. To replace, set the combined unit on top of the radiator opening, fit into position, turn the handle, gripping firmly, clockwise till the cap is tight. Lift the radiator cap pressure lever, move the pivot strip till it clears the radiator cap, the pressure lever will now snap Closed. Note: pressure release levers in normal state are always in a locked position. Radiator caps equipped with these levers cannot be turned or moved til the lever is raised.

DRAWING FIGURES

Reference numerals in drawings

Figures 1A, 1B:
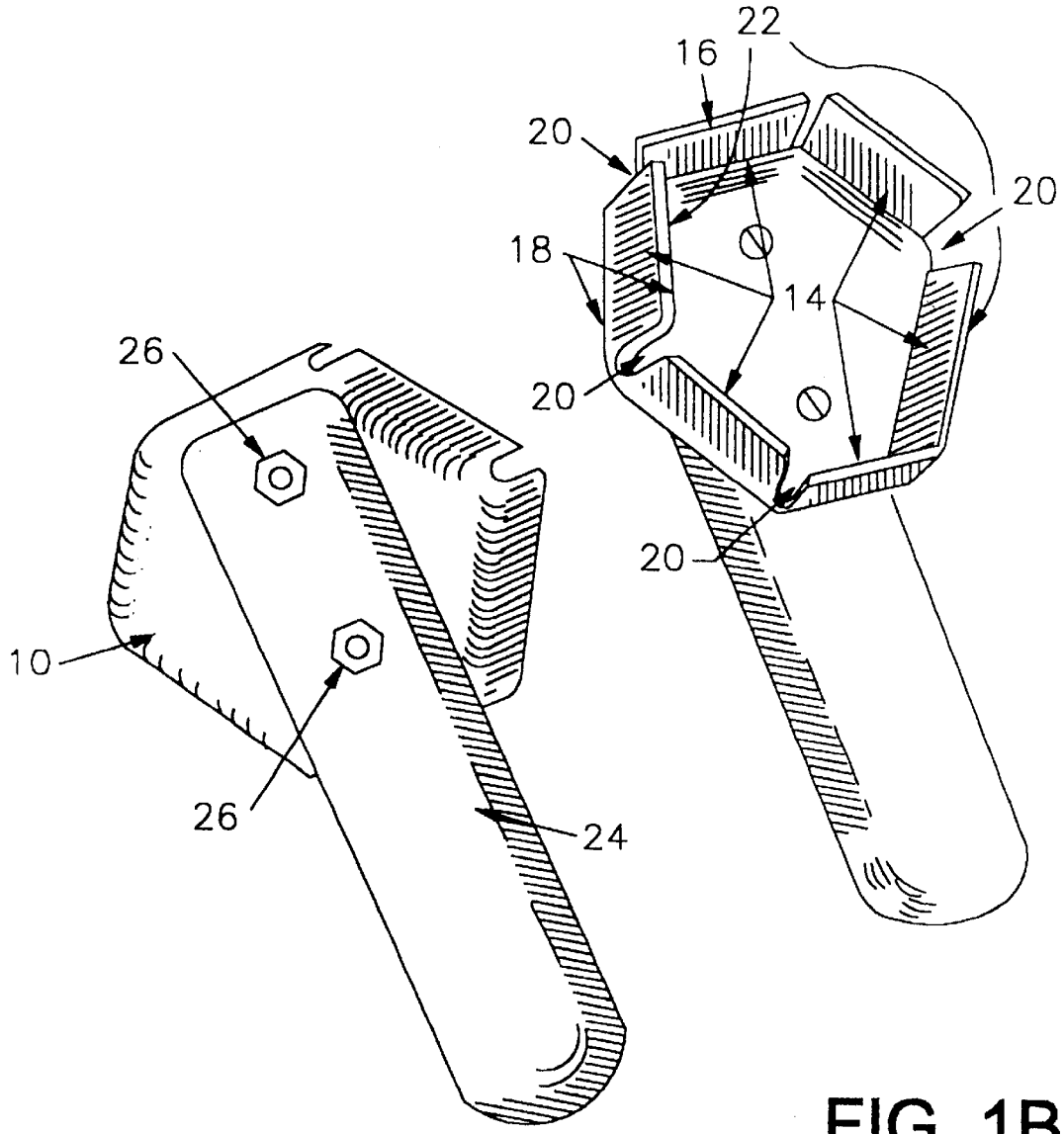
FIGS. 1A and 1B shows top view and bottom view of first embodiment.
Figure 2A:
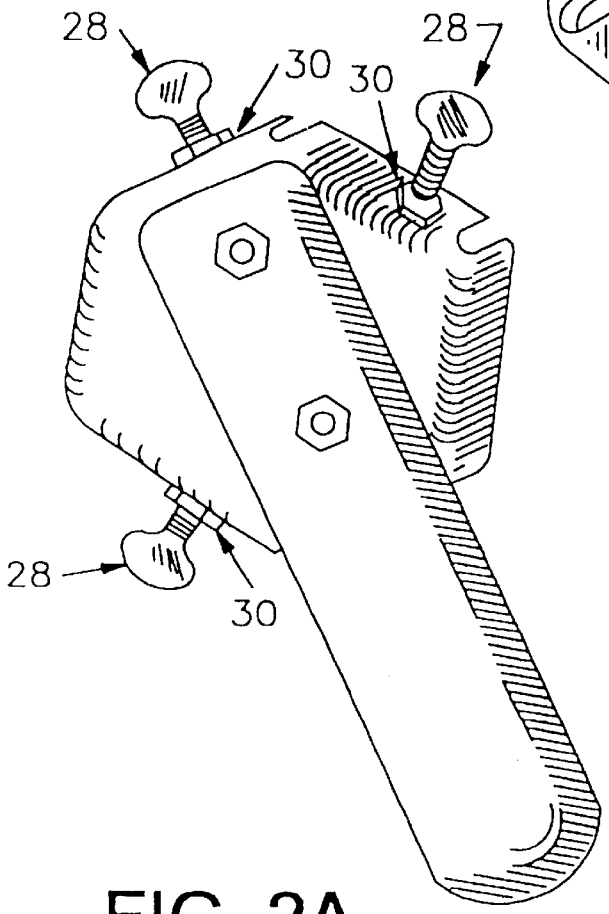
FIGS. 2A and 2B shows top view and bottom view of second embodiment, including adjusting thumbscrews.
Figure 2B:
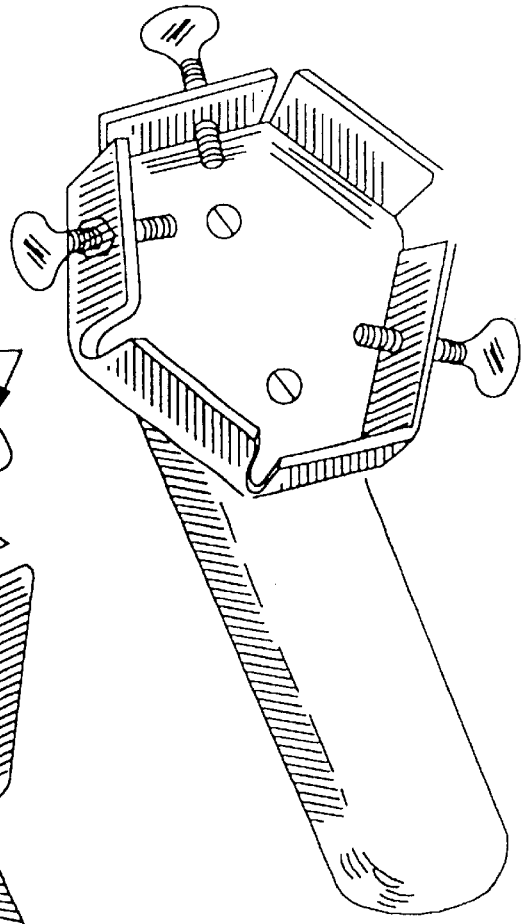
Figures 3A, 3B:
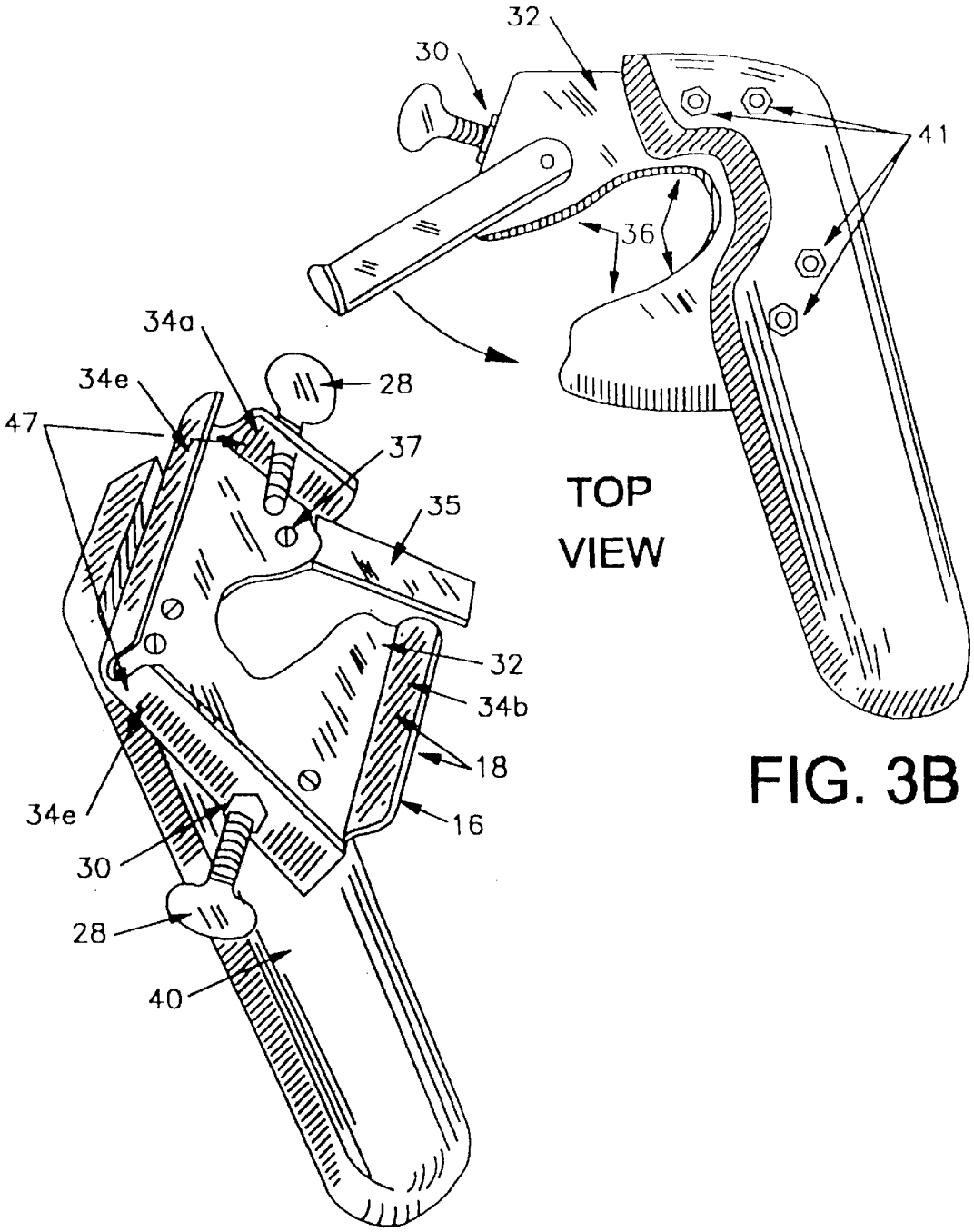
FIGS. 3A and FIG. 3B shows the top and bottom view of the third embodiment, including the thumbscrews, and pivotal strip used for radiator caps with pressure release levers.
Figure 4:
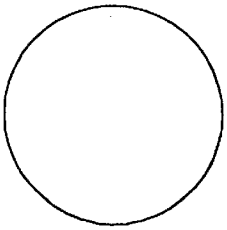
FIG. 4 shows the top of a circular shape that can be used with embodiments 2 and 3.
Figure 5:
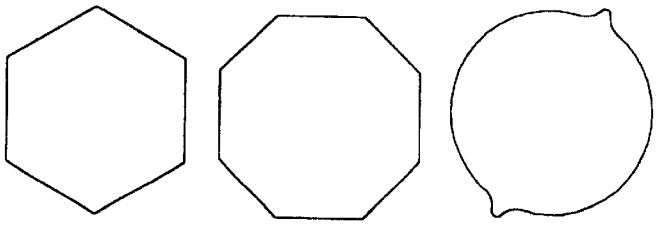
FIG. 5 shows the top shapes of radiator caps that can be used with embodiment 1.
Figure 6:
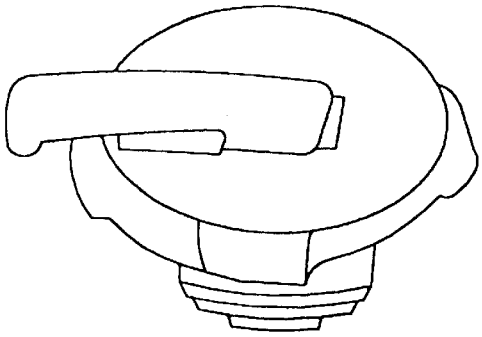
FIG. 6 shows a typical view of radiator cap equipped with a pressure/release lever in normal closed, locked position.
Figure 7:
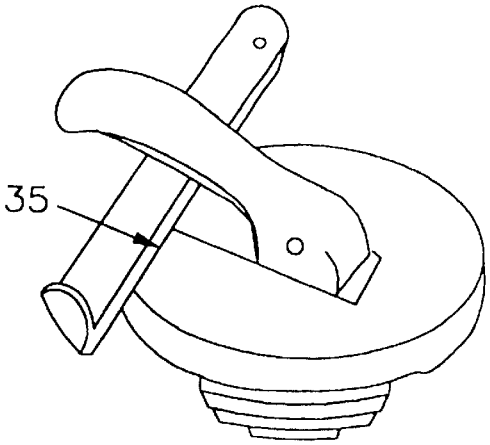
FIG. 7 shows a typical view of a radiator cap equipped with a pressure release lever in open position. This view shows the pivotal strip 35 with the lever raised.
Figure 8:
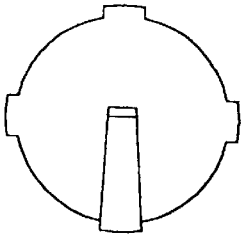
FIG. 8 shows a typical top view of a radiator cap equipped with pressure release lever.
Figure 9:
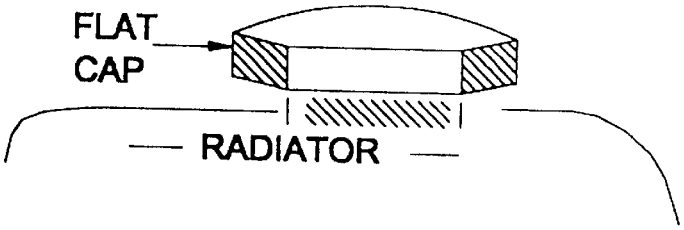
FIG. 9 shows a partial view of a radiator with an attached flat radiator cap.

10 base 10
14 various sides
16 thickness
18 height
20 open space
22 inside measurement
24 wooden handle
26 nuts and bolts
28 thumbscrews
30 machine nut
32 base
34*a* side
34*b* side
34*e* sides
35 pivotal strip
36 cutout
37 nut and bolt
40 wooden handle
41 nuts and bolts
47 parallel sides

Summary Repeated

I claim that my invention is a hand or hands held embodiment that enables a human being to loosen and remove, replace and tighten an automotive radiator cap with less physical effort than was ever done before.

Preamble: A labor saving method supplied by a device enabling a human being to remove or replace an automotive radiator cap using less physical strength.

What is claimed is:

1. I claim a hand held device for removing and replacing automotive radiator caps of various shapes said device comprising a horizontal handle attached to a generally rigid first body member sail body member having an upper and lower side said lower side having a plurality of protruded members attached to said lower side mounted perpendicular to a surface of said first body member having a movable pivot strip spanning a horseshoe type cutout attached to the topside of said first body member enabling the removal and replacement of a lever type pressure release radiator cap whereby lifting said lever of said radiator cap said movable pivot strip can be moved under said lever thereby locking said lever in place enabling removal of said radiator cap.

2. I claim a hand held device for removing and replacing automotive radiator caps of various shapes said device comprising a horizontal handle attached to a generally rigid first body member said body member having an upper and lower side said lower side having a plurality of protruded members mounted perpendicular to a surface of first body member first body member having an encircled cutout whereby lifting lever of a pressure release radiator cap first body member with encircled cutout is placed over said radiator cap releasing said lever first body member is locked in place enabling removal and replacement of said radiator cap.

* * * * *